US007981493B2

(12) United States Patent
Tanaka et al.

(10) Patent No.: US 7,981,493 B2
(45) Date of Patent: Jul. 19, 2011

(54) PACKING BUFFER MEMBER

(75) Inventors: Mutsumi Tanaka, Yokohama (JP); Yoshihiko Hisadome, Fujimino (JP); Yukinobu Kojima, Yokohama (JP); Takashi Narasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 445 days.

(21) Appl. No.: 12/169,409

(22) Filed: Jul. 8, 2008

(65) Prior Publication Data

US 2009/0041969 A1 Feb. 12, 2009

(30) Foreign Application Priority Data

Aug. 8, 2007 (JP) ..... 2007-207002

(51) Int. Cl.
*B29D 22/00* (2006.01)
*B29D 23/00* (2006.01)
*B32B 1/08* (2006.01)

(52) U.S. Cl. ..... 428/35.7; 428/76; 428/34.1; 206/521; 206/592; 206/701; 206/586; 206/587

(58) Field of Classification Search ..... 428/36.92, 428/35.7, 34.1, 76; 206/521, 592, 701, 586, 206/587
See application file for complete search history.

(56) References Cited

U.S. PATENT DOCUMENTS

2003/0165659 A1* 9/2003 Yoshimura ..... 428/98
2006/0108255 A1* 5/2006 Chu ..... 206/521

FOREIGN PATENT DOCUMENTS

JP 2005-247396 9/2005

* cited by examiner

*Primary Examiner* — Michael C Miggins
(74) *Attorney, Agent, or Firm* — Cowan, Liebowitz & Latman, P.C.

(57) ABSTRACT

A packing buffer member of the present invention is a packing buffer member 200 or 300 that is to be placed inside a pack 400 with an object to be packed 100, and includes first hollow convex parts 210, 220, 230 and 240 (third hollow convex parts 310, 320, 330 and 340) that are formed in a first direction relative to a forming base surface 201 or 301 and that contact with the object to be packed 100 to hold the object to be packed 100 and second hollow convex parts 250, 260, 270 and 280 (the fourth hollow convex parts 350, 360, 370 and 380) that are formed in a second direction opposite to the first direction relative to the forming base surface 201 or 301 and that contact inside the pack. The packing buffer member 200 or 300 is formed by a plastic sheet.

2 Claims, 6 Drawing Sheets

PACKING BUFFER MEMBER

BACKGROUND OF THE INVENTION

The present invention relates to a packing buffer member, and more particularly to a packing buffer member for packing a precision apparatus such as a lens that is subject to breakage.

Conventionally, there was a packing method as shown in FIG. 5. This method is a method for packing an object to be packed 10 such as precision apparatuses using an upper packing buffer member 20 and a lower packing buffer member 30. The upper packing buffer member 20 and the lower packing buffer member 30 are buffer members that have a configuration in which a buffer part that absorbs a shock for the object to be packed 10 from outside the pack and a holding part that holds the object to be packed 10 are integrated.

The upper packing buffer member 20 and the lower packing buffer member 30 have a good performance in buffering the object to be packed 10. However, as shown in a side view of lower right of FIG. 5, height A of the upper packing buffer member 20 and height B of the lower packing buffer member 30 cause height A+B when these packing buffer members are stored. Therefore, if buffer members as described above are used, there were problems in the store workability. For example, the buffer members needed much space when they are stored.

In order to improve such store workability, for example, Japanese Patent Laid-Open No. 2005-247396, as shown in a side view of left lower of FIG. 5, discloses a packing buffer member 50 that can be stored without much space even if they are stacked.

The packing buffer member disclosed in Japanese Patent Laid-Open No. 2005-247396 (Page 9, FIG. 1) has a configuration including a buffer part that has space around an object to be packed so that a holding part holding the object to be packed such as precision apparatuses and the buffer part absorbing the shock from outside the pack can be combined.

However, the packing buffer member disclosed in Japanese Patent Laid-Open No. 2005-247396, as described above, has a configuration including the buffer part that has space around the holding part of the object to be packed in order to combine a buffer performance and a fixation of the object to be packed. Such a configuration may need more depth to be molded in accordance with the shape of the object to be packed, and it is also technically difficult to mold such a configuration. Therefore, the thickness of plastic sheet material needed to be increased.

BRIEF SUMMARY OF THE INVENTION

The present invention provides a packing buffer member in which the used amount of plastic sheet material is reduced.

Typical one among packing buffer members of the present invention is a packing buffer member that is formed by thermoforming a sheet thermoplastic resin and that is to be placed inside a pack with an object to be packed. The packing buffer member includes a plurality of first hollow convex parts that are formed so as to protrude in a first direction relative to a forming base surface and that contact with the object to be packed to hold the object to be packed and a plurality of second hollow convex parts that are formed so as to protrude in a second direction opposite to the first direction relative to the forming base surface and that contact inside the pack.

Other aspects of the present invention will be apparent from the embodiments described below with reference to the drawings.

DETAILED DESCRIPTION OF THE PREFERRED EMBODIMENTS

Exemplary embodiments of the present invention will be described below in detail with reference to the accompanied drawings.

Figure 1:
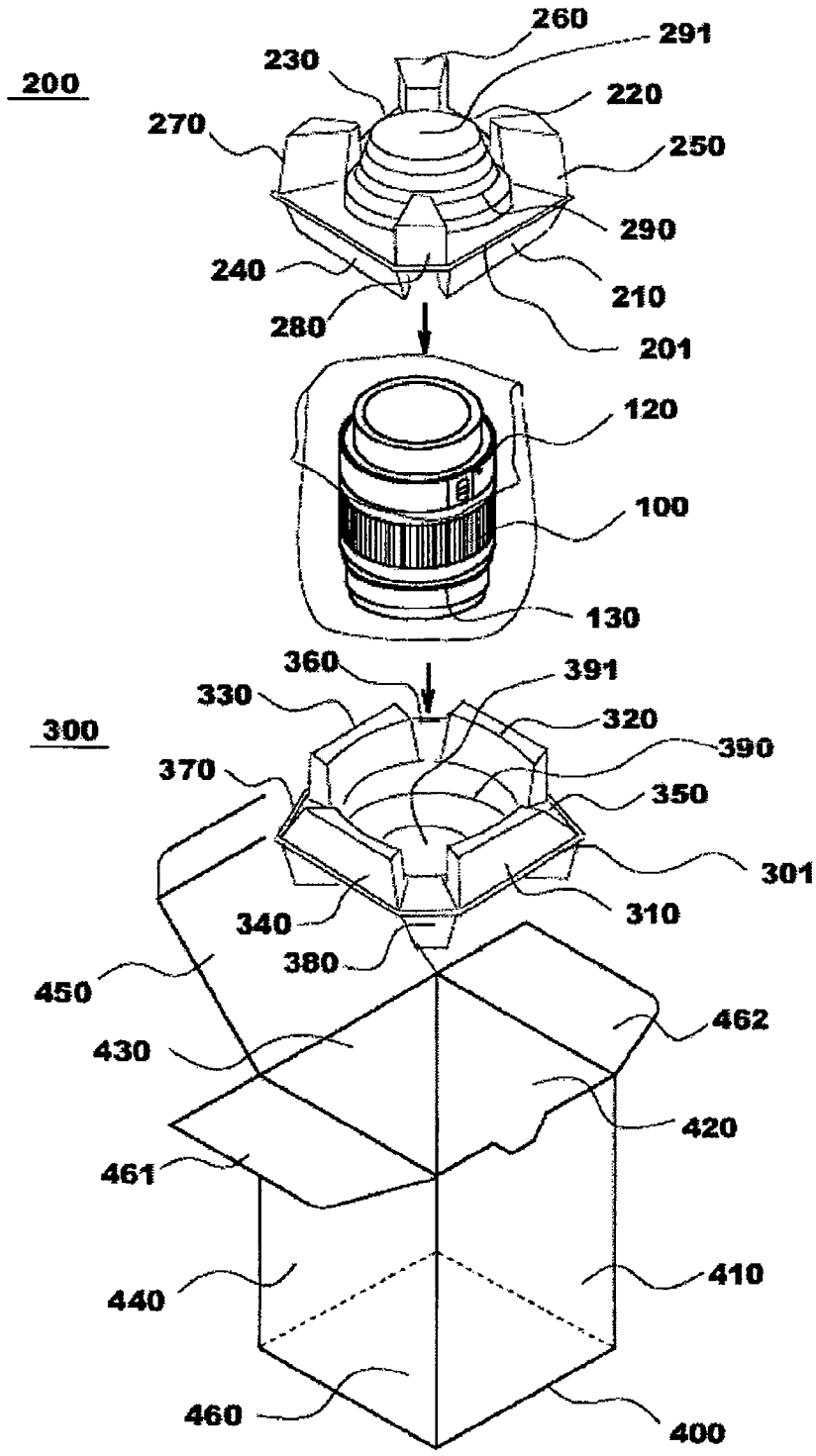
FIG. 1 is a perspective view showing the whole configuration in the embodiment of the present invention.
Figure 2:
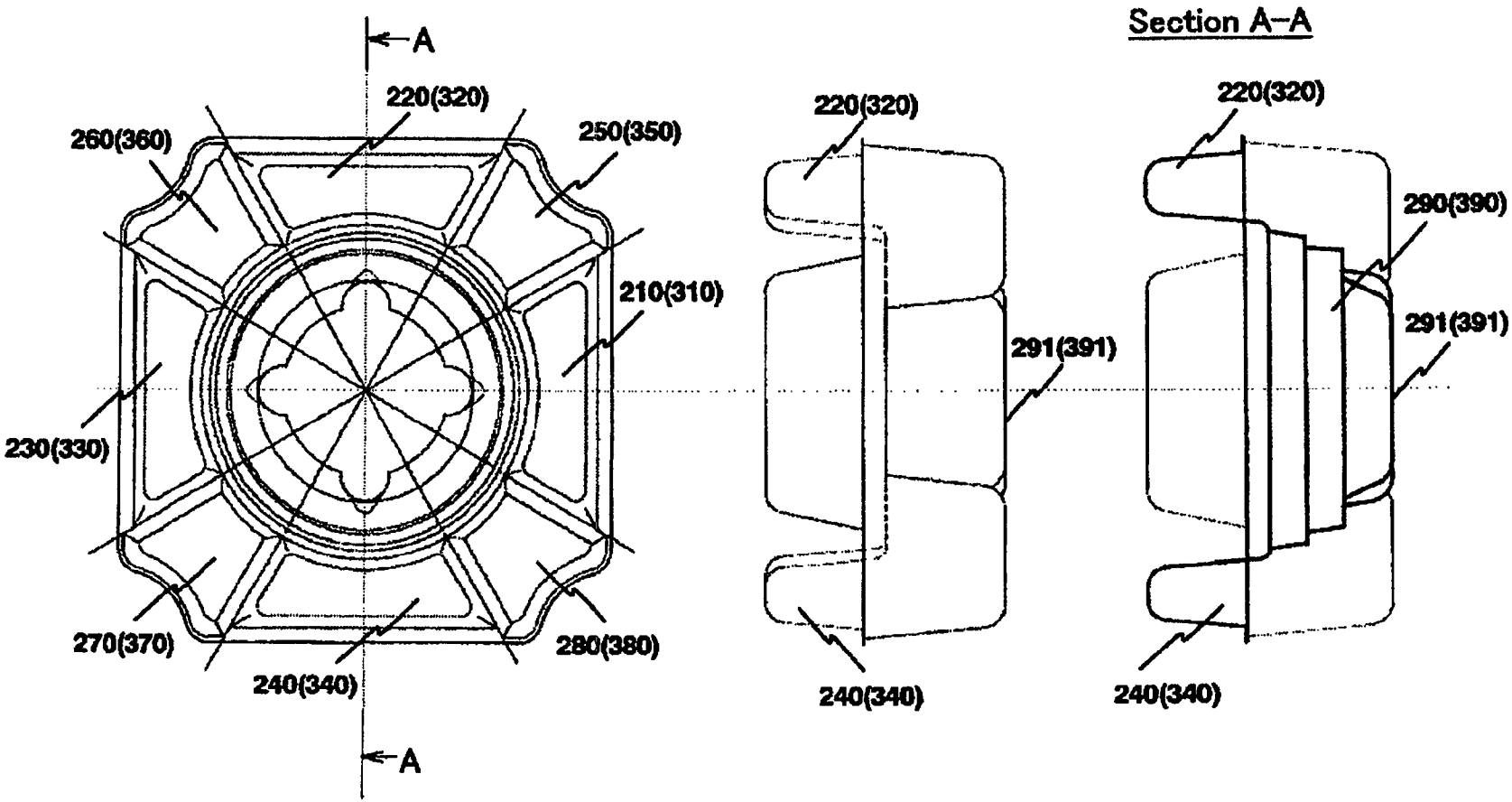
FIG. 2 is an outline view and a cross-sectional view of a packing buffer member in the embodiment of the present invention.
Figure 3:
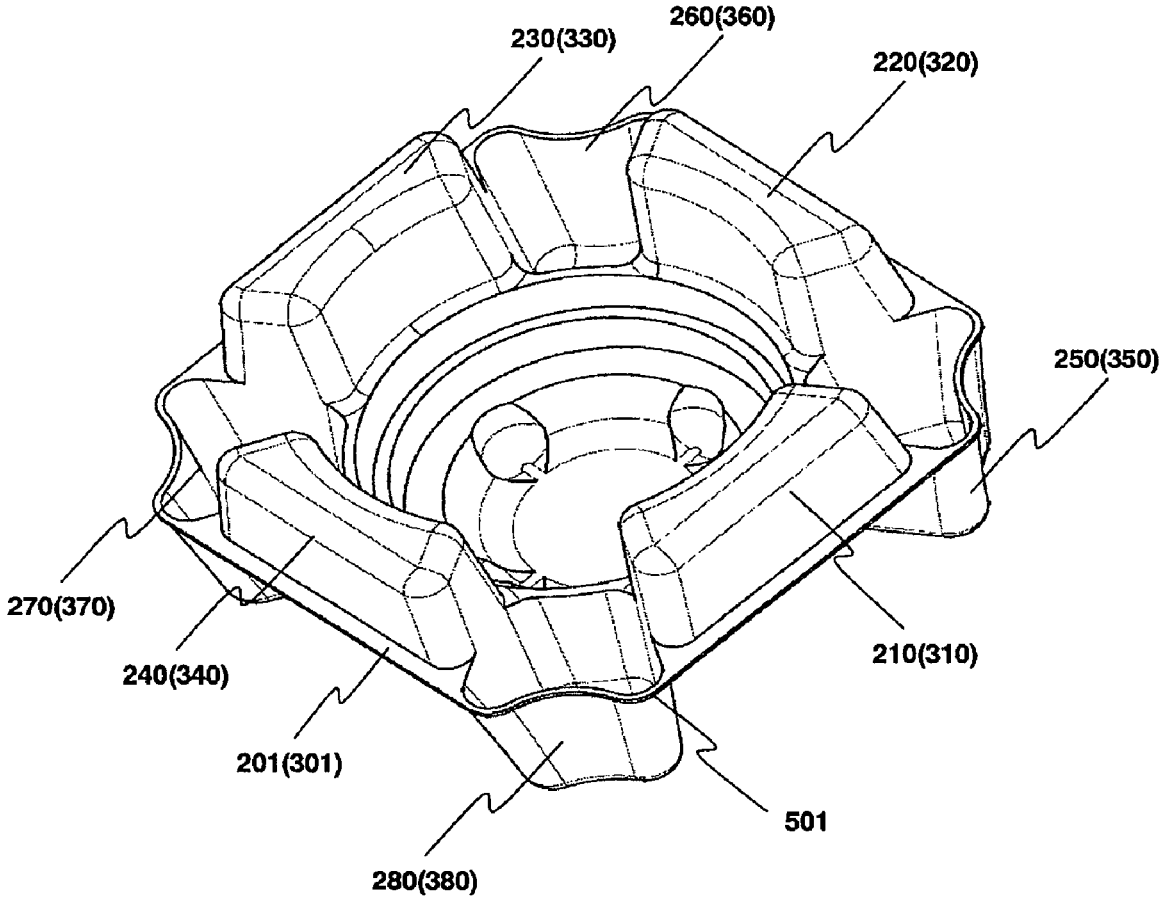
FIG. 3 is a perspective view of a packing buffer member in the embodiment of the present invention.
Figure 4A:
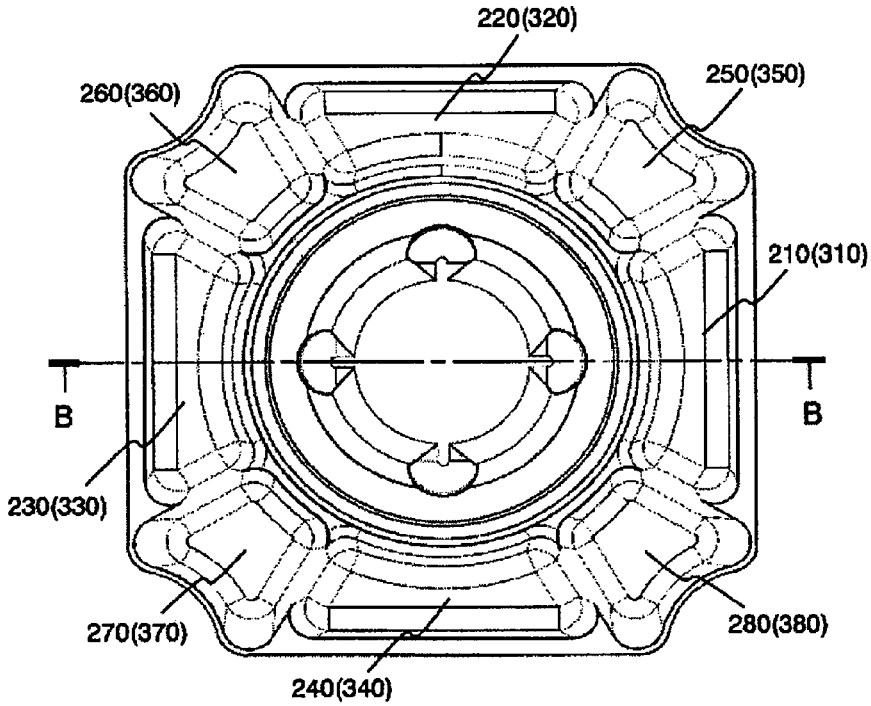
FIG. 4A is a plan view of a packing buffer member in the embodiment of the present invention.
Figure 4B:
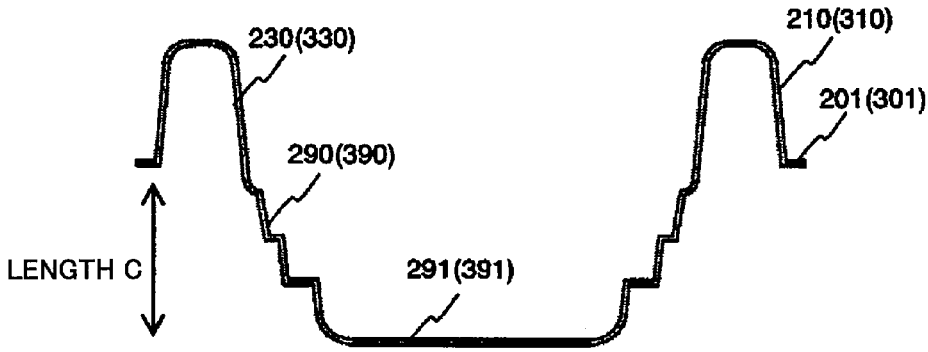
FIG. 4B is a cross-sectional view of Section B-B in FIG. 4A.
Figure 4C:
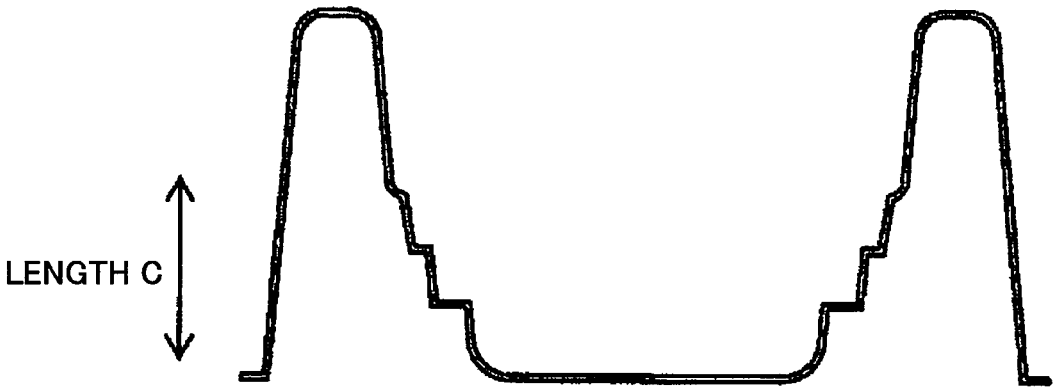
FIG. 4C is a cross-sectional view of a conventional configuration.
Figure 5:
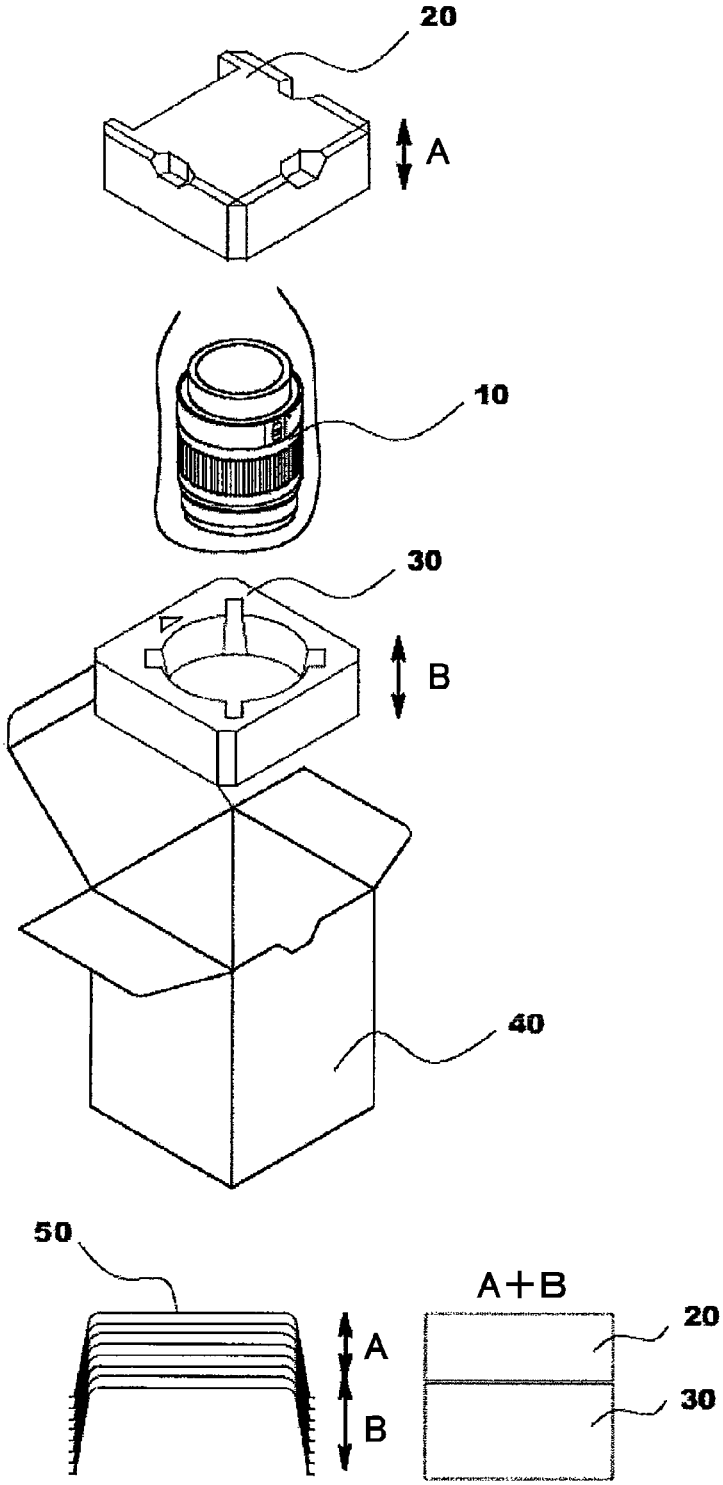
FIG. 5 is a perspective view showing a conventional packing method and a side view of a conventional packing buffer member.

FIG. 1 is a perspective view that shows a whole configuration including a pack 400, where a packing buffer member of the present embodiment is applied. FIG. 2 is an outline plan view of the packing buffer member and a cross-sectional view showing it from the direction of Section A-A. FIG. 3 is a perspective view of the packing buffer member. FIG. 4A is a plan view of the packing buffer member. FIG. 4B is a cross-sectional view of Section B-B in FIG. 4A. FIG. 4C is a cross-sectional view of a conventional configuration. Hereinafter, the present invention will be described with reference to FIGS. 1 to 4.

As shown in FIGS. 1 to 4, in the present embodiment, an object to be packed 100 such as a precision apparatus is packed using two packing buffer members of an upper packing buffer member 200 and a lower packing buffer member 300.

In FIG. 1, reference numeral 100 denotes an object to be packed in a pack 400. The object to be packed 100 includes, but is not limited to, a precision apparatus such as a lens.

Reference numeral 200 denotes an upper packing buffer member. The upper packing buffer member 200 includes first hollow convex parts 210, 220, 230 and 240 which contact with the object to be packed 100 to hold it. The first hollow convex parts 210, 220, 230 and 240 are formed so as to protrude in a first direction relative to a forming base surface 201. The upper packing buffer member 200 includes second hollow convex parts 250, 260, 270 and 280 that are formed so as to protrude in a second direction opposite to the first direction relative to the forming base surface 201 to contact with the pack 400.

In the present embodiment, the first hollow convex parts 210, 220, 230 and 240 and the second hollow convex parts 250, 260, 270 and 280 are formed at opposite sides each other with reference to the forming base surface 201. The upper packing buffer member 200 includes a holding part 290 for holding an upper surface of the object to be packed 100 and a buffer part 291 which contacts with inner top flap parts 461 and 462 of the pack 400. The holding part 290 and the buffer part 291 are formed at the side of the second hollow convex parts with reference to the forming base surface 201. The upper packing buffer member 200 is formed by vacuum forming or thermoforming a plastic sheet member or a sheet thermoplastic resin.

The forming base surface 201 of the embodiment means a plane surface that is formed at the end of the plastic sheet member. As one preferred embodiment, the upper packing buffer member 200 is formed by vacuum forming with the end of the plastic sheet member held.

Reference numeral 300 denotes a lower packing buffer member. The lower packing buffer member 300 includes third hollow convex parts 310, 320, 330 and 340 which contact with the object to be packed 100 to hold it. The third hollow convex parts 310, 320, 330 and 340 are formed so as to protrude in a third direction relative to a forming base surface 301. The lower packing buffer member 300 includes fourth hollow convex parts 350, 360, 370 and 380 that are formed in a fourth direction opposite to the third direction relative to the forming base surface 301, and that contact with the pack 400 to hold it.

In the present embodiment, the third hollow convex parts 310, 320, 330 and 340 and the fourth hollow convex parts 350, 360, 370 and 380 are formed at opposite sides each other with reference to the forming base surface 301. The lower packing buffer member 300 includes a holding part 390 for holding a lower surface of the object to be packed 100 and a buffer part 391 which contacts with an inner bottom part 460 of the pack 400. The holding part 390 and the buffer part 391 are formed at the side of the fourth hollow convex parts with reference to the forming base surface 301. The lower packing buffer member 300 is formed by molding a plastic sheet member.

The forming base surface 301 of the present embodiment means a plane surface that is formed at the end of the plastic sheet member. As one preferred embodiment, the lower packing buffer member 300 is molded with the end of the plastic sheet member held.

The first direction in which the first hollow convex parts 210, 220, 230 and 240 are formed indicates downward direction in FIG. 1. On the other hand, the second direction in which the second hollow convex parts 250, 260, 270 and 280 are formed indicates upward direction in FIG. 1. Similarly, the third direction in which the third hollow convex parts 310, 320, 330 and 340 are formed indicates upward direction in FIG. 1. The fourth direction in which the fourth hollow convex parts 350, 360, 370 and 380 are formed indicates downward direction in FIG. 1. In other words, the first direction is the same as the fourth direction, and also the second direction is the same as the third direction.

Reference numeral 400 denotes a pack for placing the object to be packed in it. The pack 400 includes inner side parts 410, 420, 430 and 440, an inner bottom part 460, inner top flap parts 461 and 462, and an inner top lid part 450.

The upper packing buffer member 200 and the lower packing buffer member 300 are placed in the pack 400 in the state of holding the object to be packed 100. At this time, the object to be packed 100 is held by the first hollow convex parts 210, 220, 230 and 240 of the upper packing buffer member 200 and by the third hollow convex parts 310, 320, 330 and 340 of the lower packing buffer member 300.

A plurality of the first hollow convex parts 210, 220, 230 and 240 which have a function of holding the object to be packed 100 among the upper packing buffer member 200 are arranged so as to contact with an outside surrounding part 120 of the object to be packed 100. Similarly, a plurality of the third hollow convex parts 310, 320, 330 and 340 which have a function of holding the object to be packed 100 among the lower packing buffer member 300 are arranged so as to contact with an outside surrounding part 130 of the object to be packed 100. The holding part 290 of the upper packing buffer member 200 and the holding part 390 of the lower packing buffer member 300 are arranged so as to hold top and bottom of the object to be packed 100, respectively.

A plurality of the second hollow convex parts 250, 260, 270 and 280 of the upper packing buffer member 200 are arranged so as to contact with the inner side parts 410, 420, 430 and 440 of the pack 400. Similarly, a plurality of the fourth hollow convex parts 350, 360, 370 and 380 of the lower packing buffer member 300 are also arranged so as to contact with the inner side parts 410, 420, 430 and 440. Thus, the second hollow convex parts 250, 260, 270 and 280 and the fourth hollow convex parts 350, 360, 370 and 380 contact with an inner surrounding area of the pack 400.

Furthermore, the buffer part 291 of the upper packing buffer member 200 and the buffer part 391 of the lower packing buffer member 300 are arranged so as to contact with the inner top flap parts 461 and 462 and with the inner bottom part 460 of the pack 400, respectively. The buffer parts 291 and 391 are held by the inner top lid part 450.

When the upper packing buffer member 200 and the lower packing buffer member 300 hold the object to be packed 100, the buffer parts 291 and 391 make space at around top and bottom of the object to be packed 100 to buffer the shock. In other words, even if the shock is given to top or bottom of the pack 400 by falling or the like, it does not reach to the object to be packed 100 because the buffer part 291 or 391 is deformed. Furthermore, when the shock is given to top or bottom of the pack 400, the second hollow convex parts 250, 260, 270 and 280 or the fourth hollow convex parts 350, 360, 370 and 380 also deform at the same time to absorb the shock. When the shock is applied to side of the pack 400, the first to the fourth hollow convex parts deform to absorb the shock.

As described above, the packing buffer member of the present embodiment can achieve the stable shock absorption performance without rotation, displacement or vibration of the packing buffer member caused by the shock, the weight, or the like, from outside the pack.

With respect to the upper packing buffer member 200, the first hollow convex parts 210, 220, 230 and 240 and the second hollow convex parts 250, 260, 270 and 280 are arranged at opposite sides each other with reference to the forming base surface 201. Protrusions of the first hollow convex parts 210, 220, 230 and 240 and protrusions of the second hollow convex parts 250, 260, 270 and 280 are formed so as to face in a first direction and a second direction opposite to the first direction, respectively.

In this respect, the lower packing buffer member 300 also has a configuration similar to the upper packing buffer member 200. In other words, the third hollow convex parts 310, 320, 330 and 340 and the fourth hollow convex parts 350, 360, 370 and 380 are arranged at opposite sides each other with reference to the forming base surface 301. Protrusions of the third hollow convex parts 310, 320, 330 and 340 and protrusions of the fourth hollow convex parts 350, 360, 370 and 380 are formed so as to face in a third direction and a fourth direction opposite to the third direction, respectively.

As described above, in accordance with the packing buffer member of the present embodiment, the first hollow convex parts and the second hollow convex parts are arranged at opposite sides with reference to the forming base surface 201. The third hollow convex parts and the fourth hollow convex parts are also arranged at opposite sides with reference to the forming base surface 301. Therefore, even if the shock, the weight, or the like from outside the pack is given to the packing buffer member, the shock from outside is prevented from directly reaching to the packing buffer member since it can be dispersed by the packing buffer member.

With respect to the upper packing buffer member 200, gaps are formed between adjacent parts of a plurality of the first hollow convex parts 210, 220, 230 and 240. With reference to the forming base surface 201, a plurality of the second hollow convex parts 250, 260, 270 and 280 are formed at positions opposite to the positions of the gaps. Thus, the first hollow convex parts 210, 220, 230 and 240 and the second hollow convex parts 250, 260, 270 and 280 are alternately arranged in a circumferential direction of the forming base surface 201 when viewed in a plan view of the forming base surface 201.

The lower packing buffer member 300 also has a configuration similar to that of the upper packing buffer member 200. In other words, gaps are formed between adjacent parts of a plurality of the third hollow convex parts 310, 320, 330 and 340. With reference to the forming base surface 301, a plurality of the fourth hollow convex parts 350, 360, 370 and 380 are formed at positions opposite to the positions of the gaps. Thus, the third hollow convex parts 310, 320, 330 and 340 and the fourth hollow convex parts 350, 360, 370 and 380 are alternately arranged in a circumferential direction of the forming base surface 301 when viewed in a plan view of the forming base surface 301.

As described above, in accordance with the configuration of the present embodiment, gaps are formed between the adjacent parts of the first hollow convex parts 210, 220, 230 and 240 and the third hollow convex parts 310, 320, 330 and 340, respectively. Therefore, even if the shock, the weight, or the like from outside the pack 400 is given to the packing buffer member, the packing buffer member can disperse the shock or the like.

With respect to the upper packing buffer member 200, the second hollow convex parts 250, 260, 270 and 280 are arranged at four corners. The lower packing buffer member 300 also has a configuration similar to that of the upper packing buffer member 200. The fourth hollow convex parts 350, 360, 370 and 380 are also arranged at four corners.

In accordance with the above configuration of the present embodiment, even if the shock, the weight, or the like from outside is given to the corner of top and bottom of the pack 400, the packing buffer member can effectively absorb the shock.

As can be seen from the perspective view shown in FIG. 3, with respect to the upper packing buffer member 200, each of the second hollow convex parts 250, 260, 270 and 280 which contact with the pack 400 has an R-shaped part 501 (a curved surface shape) at a position where the second hollow convex part contacts with the pack 400. Similarly, with respect to the lower packing buffer member 300, each of the fourth hollow convex parts 350, 360, 370 and 380 which contact with the pack 400 has an R-shaped part 501 at a position where the fourth hollow convex part contacts with the pack 400.

Thus, even if the shock, the weight, or the like from outside is given to the corner of top and bottom of the pack 400, the packing buffer member can effectively absorb the shock from outside since the R-shaped parts bend.

The upper packing buffer member 200 has four second hollow convex parts 250, 260, 270 and 280 so as to contact with the pack 400. Similarly, the lower packing buffer member 300 also has four fourth hollow convex parts 350, 360, 370 and 380 so as to contact with the pack 400. In accordance with such a configuration, the upper packing buffer member 200 and the lower packing buffer member 300 can be stably arranged at the corners of top and bottom of the pack 400.

As described above, the upper packing buffer member 200 and the lower packing buffer member 300 have four second hollow convex parts 250, 260, 270 and 280 and four fourth hollow convex parts 350, 360, 370 and 380, respectively. However, the number of the second and the fourth hollow convex parts is not limited to four, respectively. Hollow convex parts, the number of which is more than four, can be also applied to the present invention. The packing buffer member in accordance with such a configuration can further improve the stability.

Next, with reference to FIGS. 4A to 4C, it will be explained that the length of the molded part of the packing buffer member of the present embodiment is shorter than that of conventional one.

As shown in FIGS. 4A to 4C, with respect to the upper packing buffer member 200, the length of the molded part forming the first hollow convex parts 210, 220, 230 and 240 that have a function of holding the object to be packed 100 is length C shorter than the conventional configuration. The same is true for the third hollow convex parts 310, 320, 330 and 340 of the lower packing buffer member 300.

As shown in FIGS. 4B and 4C, length C is a distance between the forming base surface 201 (301) and the buffer part 291 (391). Length C is longer than half of the length from the buffer part 291 (391) to the top surface of the first hollow convex parts 210 and 230 (the third hollow convex parts 310 and 330). However, Length C is not limited to that. In accordance with the configuration of the packing buffer member, length C can be also shorter than half of the length from the buffer part 291 (391) to the top surface of the first hollow convex parts 210 and 230 (the third hollow convex parts 310 and 330)

In accordance with such a configuration, the upper packing buffer member 200 and the lower packing buffer member 300 can be molded by a thinner sheet material. Therefore, it contributes to the reduction in weight and cost.

As described above, according to the present embodiment, the upper packing buffer member 200 has the first hollow convex parts 210, 220, 230 and 240 that hold the object to be packed 100 and the second hollow convex parts 250, 260, 270 and 280 that contact with the pack 400. Similarly, the lower packing buffer member 300 has the third hollow convex parts 310, 320, 330 and 340 that hold the object to be packed 100 and the fourth hollow convex parts 350, 360, 370 and 380 that contact with the pack 400.

According to such a configuration, the packing buffer member of the present embodiment can effectively protect the object to be packed 100 from the shock from outside the pack.

With respect to the upper packing buffer member 200, the first hollow convex parts 210, 220, 230 and 240 that hold the object to be packed 100 and the second hollow convex parts 250, 260, 270 and 280 that contact with the pack 400 are arranged in the opposite directions each other, based on the forming base surface 201. Similarly, the third hollow convex parts 310, 320, 330 and 340 that hold the object to be packed 100 and the fourth hollow convex parts 350, 360, 370 and 380 that contact with the pack 400 are arranged in the opposite directions each other, based on the forming base surface 301.

According to such a configuration, even if the shock, the weight, or the like from outside the pack is given to the packing buffer member, the shock from outside is prevented from directly reaching to the packing buffer member since it can be dispersed by the packing buffer member.

With respect to the upper packing buffer member 200, the first hollow convex parts 210, 220, 230 and 240 and the second hollow convex parts 250, 260, 270 and 280 are alternately arranged based on the forming base surface 201. Similarly, with respect to the lower packing buffer member 300, the third hollow convex parts 310, 320, 330 and 340 and the fourth hollow convex parts 350, 360, 370 and 380 are alternately arranged based on the forming base surface 301. In this regard, gaps are formed between adjacent parts of a plurality of the first hollow convex parts 210, 220, 230 and 240 of the upper packing buffer member 200 and the third hollow convex parts 310, 320, 330 and 340 of the lower packing buffer member 300, respectively.

In accordance with such a configuration, even if the packing buffer member receives the shock, the weight or the like from outside the pack 400, it can effectively disperse the shock or the like from outside the pack.

With respect to the upper packing buffer member 200, the length of the molded part forming the first hollow convex parts 210, 220, 230 and 240 can be shortened. The same is true for the third hollow convex parts 310, 320, 330 and 340 of the lower packing buffer member 300.

In accordance with such a configuration, the first hollow convex parts and the second hollow convex parts can be formed with shallow molding depth. Therefore, a thinner sheet material can be used for the upper packing buffer member 200 and the lower packing buffer member 300. As a result, it contributes to the reduction in weight and cost of the packing buffer member. The present embodiment can provide the packing buffer member in which the used amount of the plastic material is reduced.

Although the present invention was specifically explained based on the embodiment, it is not limited to the above embodiment and various variations and modifications may be made without departing from the scope of the present invention. For example, in the present embodiment, the first direction in which the first hollow convex parts are formed and the second direction in which the second hollow convex parts are formed are opposite each other. However, the first direction and the second direction do not need to be strictly opposite each other. The first hollow convex parts and the second hollow convex parts can be formed in different directions each other without departing from the scope of the present invention.

This application claims the benefit of Japanese Patent Application No. 2007-207002, filed on Aug. 8, 2007, which is hereby incorporated by reference herein in its entirety.

What is claimed is:

1. A packing buffer member that is formed by a sheet thermoplastic resin and that is to be placed inside a pack with an object to be packed, the packing buffer member comprising:

a plurality of first hollow convex parts that are formed so as to protrude in a first direction relative to a forming base surface and that contact with an outside surrounding part of the object to be packed to hold the object to be packed;

a plurality of second hollow convex parts that are formed so as to protrude in a second direction opposite to the first direction relative to the forming base surface and that contact inside the pack;

a holding part that holds an upper surface or a lower surface of the object to be packed, the holding part being formed so as to protrude in the second direction relative to the forming base surface; and a buffer part that is formed so as to protrude in the second direction relative to the holding part and that contacts inside the pack, wherein the first hollow convex parts and the second hollow convex parts are alternately arranged in a circumferential direction of the holding part, and wherein the second hollow convex parts are arranged at four corners of the packing buffer member.

2. A packing buffer member according to claim 1, wherein an area on which the second hollow convex parts contact inside the pack has a curved surface shape.

* * * * *